United States Patent [19]

Thievessen

[11] Patent Number: 5,020,736

[45] Date of Patent: Jun. 4, 1991

[54] DEVICE FOR CONNECTING STRIPS OF MATERIAL

[75] Inventor: Karl Thievessen, Grevenbroich, Fed. Rep. of Germany

[73] Assignee: Jagenberg Aktiengesellschaft, Fed. Rep. of Germany

[21] Appl. No.: 441,799

[22] Filed: Nov. 27, 1989

[30] Foreign Application Priority Data

Jan. 23, 1989 [DE] Fed. Rep. of Germany ..... 3901854

[51] Int. Cl.[5] ..... B65H 19/14

[52] U.S. Cl. ..... 242/58.300; 242/56 R; 242/58.5; 156/504

[58] Field of Search ..... 156/502, 504, 506; 242/58.1, 58.2, 58.3, 58.4, 58.5, 56 R

[56] References Cited

U.S. PATENT DOCUMENTS

| | | | |
|---|---|---|---|
| 1,843,472 | 2/1932 | Wood | 242/58.3 |
| 3,586,006 | 6/1971 | Wendt | 242/58.4 X |
| 3,756,526 | 9/1973 | Bassett et al. | 242/56 R |
| 3,863,854 | 2/1975 | Tokimo | 242/58.2 |
| 3,895,763 | 7/1975 | Tokuno | 242/58.3 |
| 4,564,149 | 1/1986 | Barzano | 242/58.1 |
| 4,668,328 | 5/1987 | Kyytsönen | 242/58.5 X |
| 4,705,226 | 11/1987 | Goetz | 156/504 X |
| 4,881,695 | 11/1989 | Beisswanger | 156/502 X |

FOREIGN PATENT DOCUMENTS

| | | | |
|---|---|---|---|
| 3440107 | 11/1988 | Fed. Rep. of Germany | 242/58.3 |
| 2204026 | 3/1987 | United Kingdom | 242/58.1 |

*Primary Examiner*—William A. Cuchlinski, Jr.
*Assistant Examiner*—Joseph A. Rhoa
*Attorney, Agent, or Firm*—Sprung Horn Kramer & Woods

[57] ABSTRACT

A device for connecting the end of one strip of material (6) which is being taken off a first roll with the start of a strip from a new roll (3) on a take-off machine, which is replacing the first roll, with a cutter (19) to cut the strip (6) being taken off, a device to hold the strip end (6.4) produced by this, and to press the strip end to the outside circumference of the new roll (3) replacing the old roll, in order to produce an adhesive bond, is made much simpler in design by the fact that above the take-off point, in a frame, two pairs of pivot arms (8, 13), each parallel, are attached. One pair of pivot arms (8) carries a transport element (7) to lift part (6.4) of the strip being taken off, which can be pivoted opposite the strip movement direction, from a rest position (11) behind the strip part (6.1) being guided to the guide roller (5) in the strip movement direction, into an end position (12) which is located outside the area of a full roll (3). The second pair of pivot arms (13) carries a holder element (14) at its free end, and in front of it, a press-down element (17) for the lifted strip part (6.4), and can be pivoted from the end position (12) of the first pair of pivot arms (8) in the strip movement direction up to the outside circumference of a full roll (3).

5 Claims, 3 Drawing Sheets

DEVICE FOR CONNECTING STRIPS OF MATERIAL

Figure 1:
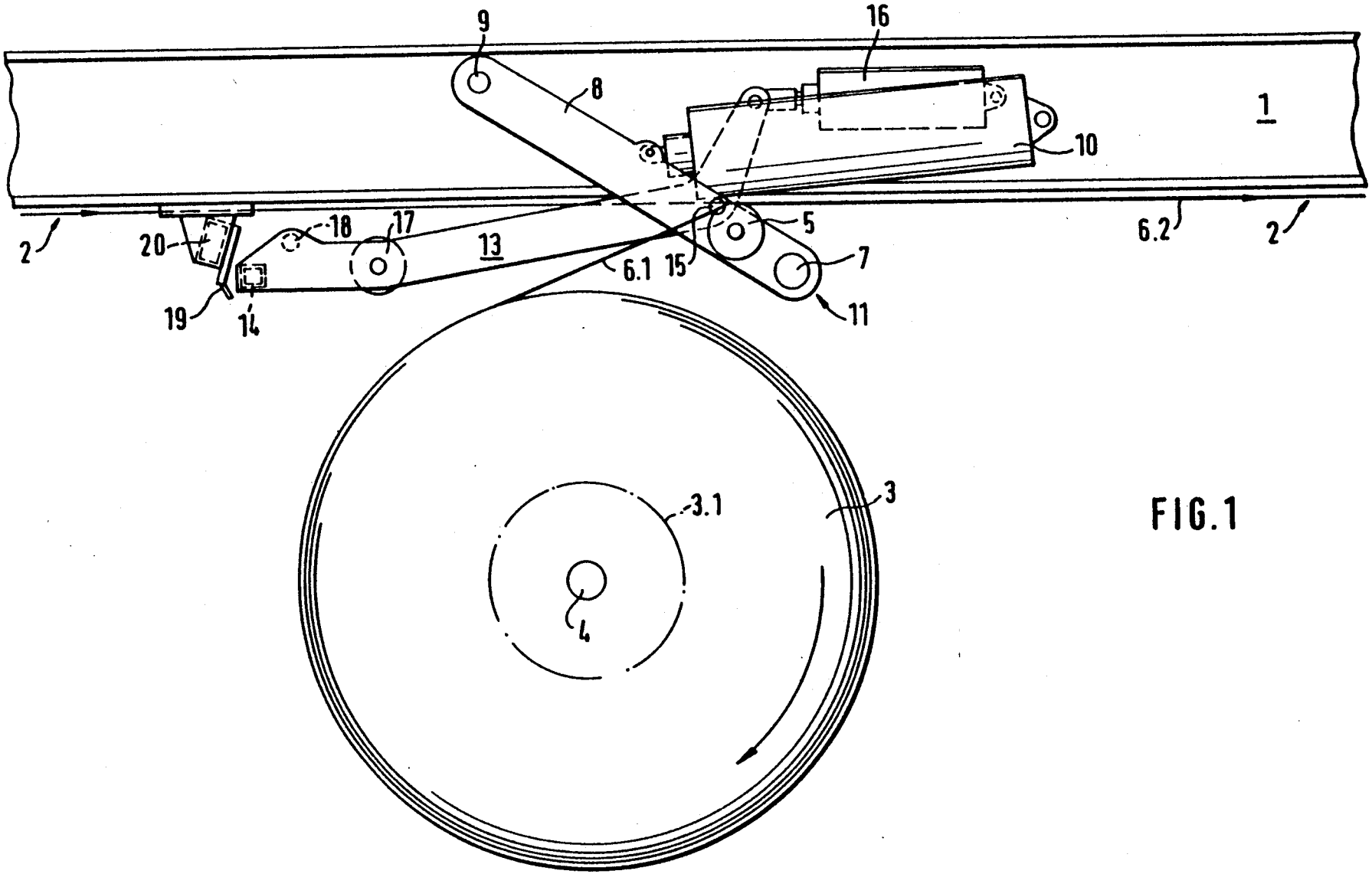

The invention concerns a device for connecting the end of one strip of material which is being taken off a first roll with the start of a strip from a new roll which is replacing the first roll.

Splicing devices are known for take-off machines for rolls of strips of material, for example paper or cardboard strips, which attach the end of the strip of material being taken off by a processing machine with the start of a strip from a new, full roll. If the machine contains fixed holder devices for the rolls, the remaining roll is cut off while the processing machine is stopped, the cut end of the strip being taken up is held in place, and attached, i.e. glued to a new roll, after the cut-off roll has been removed and the new roll has been inserted.

In order to automate the splicing process, a device of this type is known from DE-PS 34 40 107, which has a storage device for storing a supply of strip material from the material strip being taken off, a cutting device to cut off the material strip being taken off, and a driven suction roller between the storage device and the cutting device, which takes up a part of the stored supply of strip material and brings it into pressure contact with the outside circumference of the new roll, in order to create an adhesive bond with the start of the new roll, which is provided with an adhesive strip. The suction roller is affixed to a pivot arm, which demonstrates a linking point above the maximum outside circumference of the new roll, and extends in an essentially horizontal direction when at rest. The device shown there requires separate drives for holding the take-off strip in place, for moving the storage device, for the rotation and pivot movement of the suction roller, for the cutting device and for turning on the suction air. In addition, the cutting blade has to be moved out of its cutting position, since this is in the area of the strip being taken off during the take-off movement. These necessary drives require a complicated control device, which precisely triggers activation of these elements.

The invention is based on the task of creating a device of this type which requires a low number of separate drives and therefore is easier to control and less susceptible to breakdowns.

This task is accomplished with the device according to the invention which requires only four separately controlled drives for fully automatic operation, namely one for each pair of pivot levers, for the cutting process and for the holder element to hold the cut-off end of the strip in place.

The invention makes it possible to arrange the cutting device outside the path of the strip when it is being taken off, so that this device can be installed in a fixed position. By arranging the cutting device in the area between the transport element (7) in the end position (12) of the pivot levers (8) and the holder element (14) when the pivot levers (13) are pivoted up, no overhanging strip remainder which is not held in place is produced; such an overhang could result in problems when laying the strip onto the full roll. A traversing blade as the cutting device requires little space while providing reliable operation.

A blower device prevents the strip remainder from curling up between the pressing element and the holder element when it is placed on the outside of the full roll after the strip has been released from the holder element, thereby having a detrimental effect on the adhesion process.

A free-running roller as a press-down element and a suction beam with suction cups open towards the bottom are especially advantageous.

A preferred embodiment of the invention is shown in the drawings, in simplified form, and will be explained in greater detail below.

Figure 2:
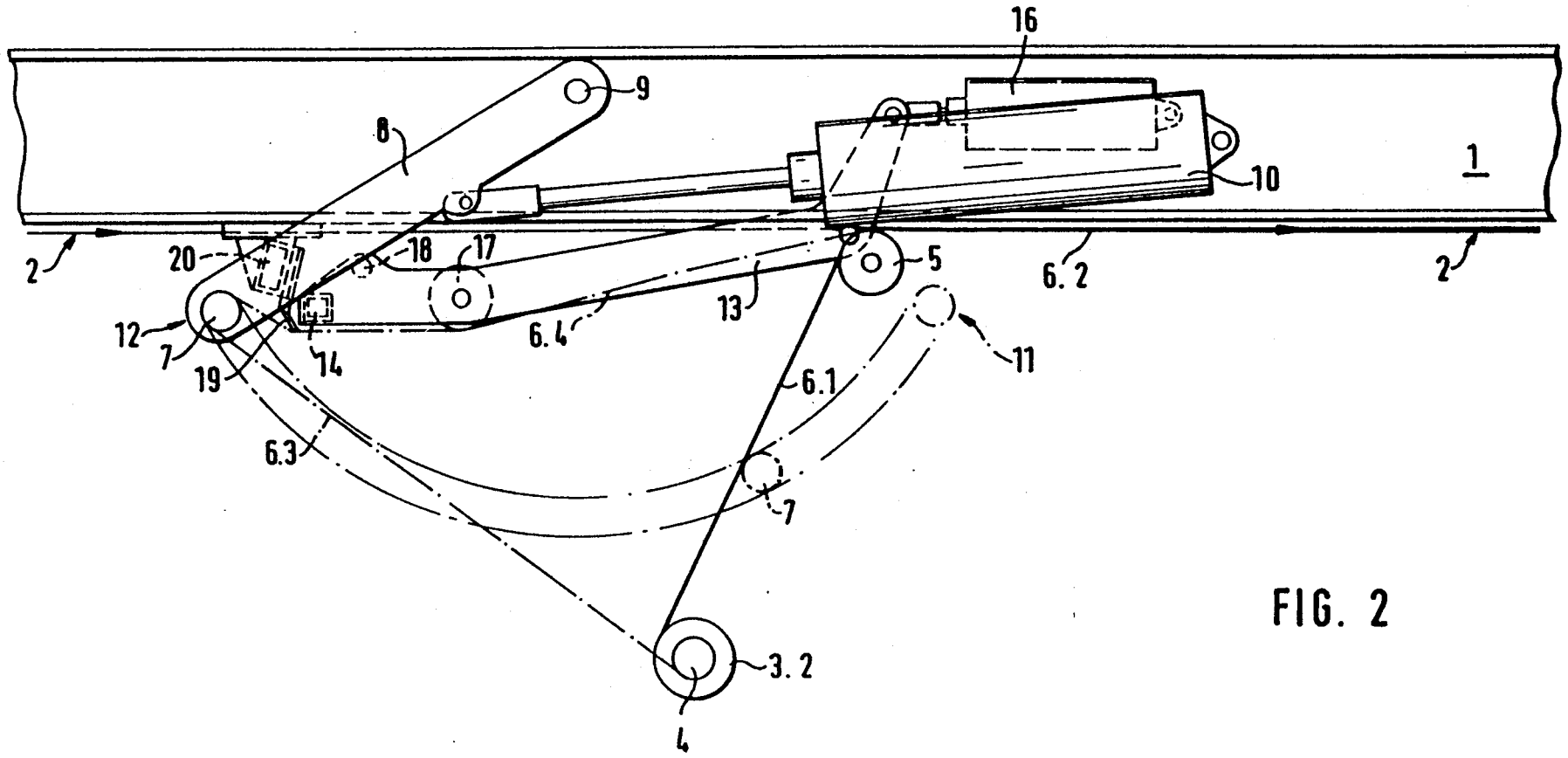
Figure 3:
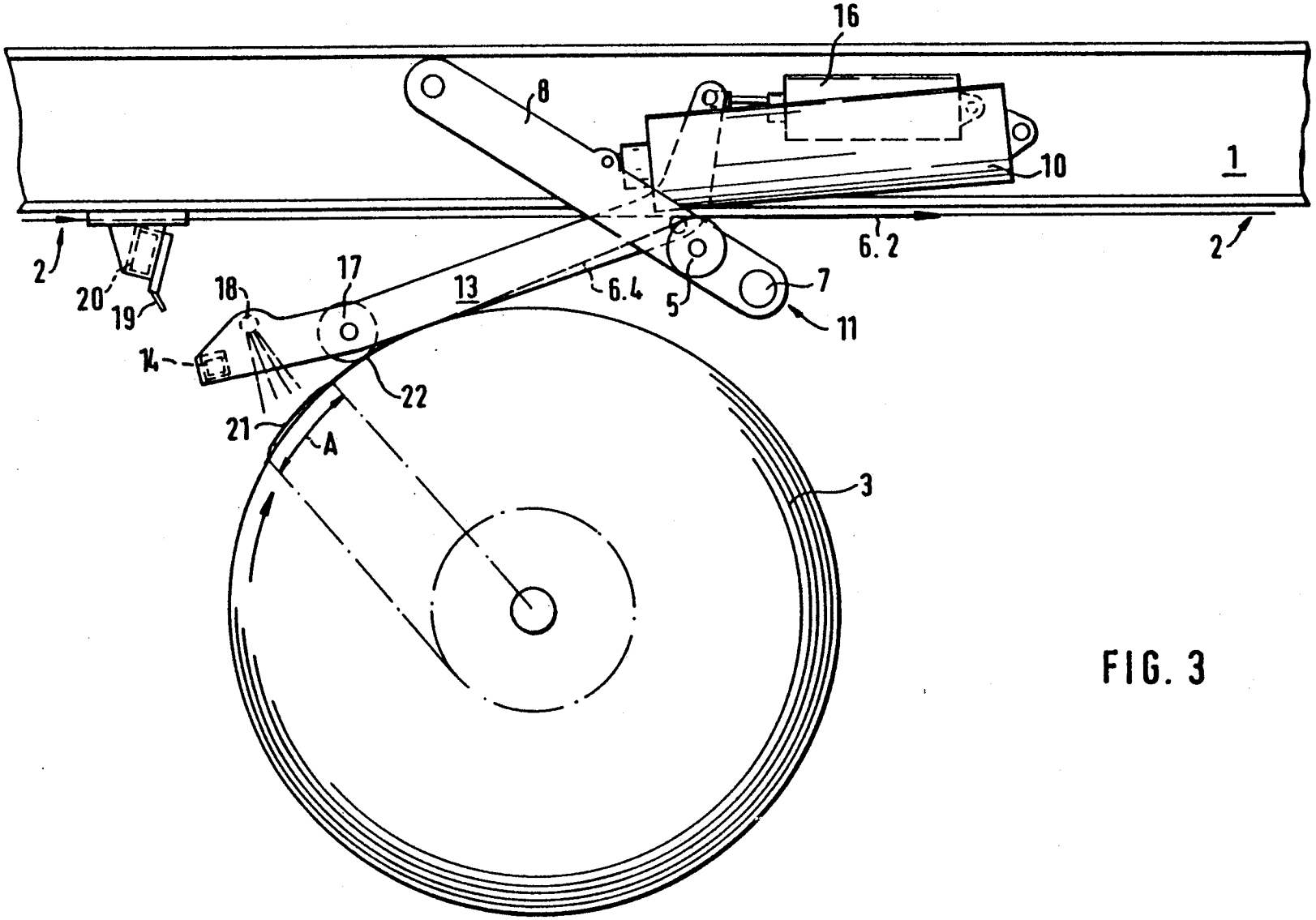

FIG. 1 to 3 show the structure and the method of operation of a device according to the invention in a side view.

The embodiment according to FIG. 1–3 is designed for use in take-off machines for rolls of paper strips, which are wound up on cardboard cores. Several such take-off machines are frequently arranged together in a frame, so that the strips taken off are brought together to form a multi-layer strip, and are subsequently processed together, for example in a cross- cutter for making sheets of paper. In these take-off machines, the strip is always taken off from the top side of a roll, towards the top. During take-off, the rolls are held by guide heads which can be inserted into the cardboard core, and which are supported by a frame or by lateral supports.

The splicing device according to the invention is attached on side bars 1 of the frame of the take-off machine, which are located above the take-off point. The side bars 1 extend on both sides of the strip guide 2, at a distance above the maximum diameter of a full roll 3, and are supports on stands, not shown. The take-off position of a full roll is determined by guide heads 4 which can be inserted into the central core. The guide heads 4 are supported in pillow blocks and connected with a brake. Slightly offset from the side of the strip run, above the take-off point and outside the area of a full roll 3 with maximum diameter, at the bottom of the side bars 1, a guide roller 5 is attached, extending over the working width, which deflects the taken-off strip 6.1, 6.2 to a horizontal direction, towards the subsequent processing machine.

The splicing device according to the invention contains a transport rod 7 which extends laterally across the working width, which is attached to the free end of a pivot lever 8 at each of its ends. The pivot levers 8 are attached to the side bars 1, at both sides of the strip guide 2, to pivot around an axis 9, which runs through the position of the guide heads 4 offset a slight distance from the vertical, opposite the strip movement direction. A piston-cylinder unit 10, attached to the side bars 1, acts on the levers 8 as a pivot drive. The levers 8 are dimensioned in such a way and attached outside the width of the strip in such a way that the transport rod 8 can be pivoted below the horizontal strip guide 2 from a rest position 11, which is located behind the guide roller 5 in the strip movement direction and above the maximum diameter of the roll 3, downwards opposite the strip movement direction—to the left in FIG. 1—to an end position 12 (FIG. 2), which is located in front of a full roll in the strip movement direction and above it, but still at a distance below the side bars 1.

At the free end of two additional lateral pivot levers 13, a strip holder element 14 which extends across the working width is attached; in the present embodiment, it is formed of a suction beam with a number of suction cups open to the bottom. The levers 13 are attached to the bottom of the side bars 1 to pivot around an axis 15 located in the vicinity of the guide roller 5, and have an extension bevelled towards the top, at the end of which a piston-cylinder unit 16 which is also attached to the side bars 1 acts as a pivot drive. At a certain distance from the holder device 14, a press-down roller 17 which extends across the working width is attached, and approximately in the middle between the holder device 14 and the press-down roller 17, a blow-pipe 18 which blows downward extends across the working width and is also attached to the levers 13 on both sides. The stroke of the piston-cylinder unit 16 and the ratios at the levers 13 are selected in such a way that the press-down roller 17 can be pivoted from the outside circumference of a full roll 3.1 with minimum diameter into the free area between the maximum diameter of the roll 3 and the strip guide 2 located directly below the side bars 1. In the upper end position, the holder element 14 is located directly adjacent to the cutting line of a blade 19 which traverses across the working width, the guide 20 of which is attached to the bottom of both side bars 1 and arranged at a sufficient distance from the strip guide 2 of strips taken off subsequently, so that it does not disturb them. The blade 19 with its guide 20 is arranged in such a way that it can be pivoted outside from the transport rod 7, as can the pivot levers 13.

In the following, the progression of a splicing process according to the invention is explained using FIG. 1–3:

FIG. 1 shows the pivot arms 8, 13 in their rest position, in which none of the splicing elements disturbs the progression of the strip 6.1, 6.2: The transport rod 7 is located in the rest position 11 in the area kept clear by the guide roller 5, behind the part of the strip 6.1 taken off towards the top. The pivot arms 13 are pivoted up, so that the press-down roller 17, the holder element 14 and the blow-pipe 18 are in the non- disruptive area above the progression of the strip 6.1 and below the strip guide 2. Due to unrolling, the diameter of the roll 3 decreases more and more, and the progression of the strip 6.1 moves down, until a pre-determined remaining diameter 3.2 is reached, at which the unrolling process is stopped (FIG. 2). Subsequently, the pivot arm 8 pivots clockwise, so that the transport rod 7 is moved from its rest position 11 and dips into the strip 6.1. During further pivoting until the end position 12 below the side bars 1 shown in FIG. 2 is reached, the strip progression 6.3, 6.4, shown with broken lines in FIG. 2, is brought about. The strip part 6.4 rests against the press-down roller 17 and against the suction surfaces of the holder element 14 and the cutting line of the blade 19 after the end position 12 of the pivot arm 8 has been reached. When the lever 8 is moved, the strip length between the remaining roll 3.1 and the guide roller 5 is lengthened, therefore the remaining roll 3.1 is unrolled some more.

Subsequently, the strip part 6.4 is held in place by turning on the suction fan for the holder element 14, and the blade 19 cuts the strip 6.4 straight across. Now the remaining roll 3.1 is removed from the guide heads 4, the transport rod 7 is moved back to the rest position 11, with the levers 8, and subsequently, a new, full roll 3 is put into place (FIG. 3). On the full roll 3, an adhesive seam 21, for example a double-sided adhesive tape, has been prepared, which is positioned in the area designated as A in FIG. 3 when the roll 3 is put into place. Subsequently, the lever 13 is pivoted down, until the press-down roller 17 rests with pressure against the outside of the roll 3. By shutting off the suction fan of the holder element 14 and turning on the blowing air in the blow-pipe 18, the cut-off strip end is placed and held onto the outside surface of the roll 3, behind the press-down roller 17. Subsequently, the strip take-off of the strip 6.2 being taken off is turned on, which causes the full roll to be put into rotation clockwise at the same time, due to friction caused by the press-down roller 17, which rests against it under pressure. When this happens, the adhesive seam 21 is moved through the slot at the press-down point 22 together with the remaining end of the strip 6.4 being taken off, which is located above it, and the adhesive bond is produced under pressure in this way.

After the adhesive seam 21 has passed through the press-down point 22, the levers 13 are pivoted up to the rest position shown in FIG. 1, and the take-off machine can be accelerated to full operating speed.

It is a significant advantage of the device according to the invention that the adhesive seam 21 does not have to be positioned precisely, but only within a certain area. This allows very simple roll preparation of the new roll for the splicing process and no other complicated control devices to position the adhesive seam 21 for production of the adhesive bond, e.g. by rotating the full roll, are necessary.

It will be understood that the specification and examples are illustrative but not limitative of the present invention and that other embodiments within the spirit and scope of the invention will suggest themselves to those skilled in the art.

What is claimed is:

1. In a take-off machine including a device for connecting the end of one strip of material which is being taken off a first roll with the start of a strip from a new roll on the take-off machine which is replacing the first roll, including means for holding the roll in each case, a guide roller arranged above the take-off point to deflect the strip being taken off, means to cut the strip being taken off, means for holding the strip end produced by such cutting, and means to press the strip end to the outside circumference of the new roll replacing the old roll, in order to produce an adhesive bond, the improvement which comprises a frame, first and second pairs of pivot arms (8, 13), each parallel, attached to the frame above the take-off point, the first pair of pivot arms (8) carrying a transport element (7) to lift part (6.4) of the strip being taken off, means for pivoting the transport element opposite the strip movement direction, from a rest position (11) behind the strip part (6.1) guided to the guide roller (5) in the strip movement direction, into an end position (12) located outside the area of a full roll (3), the second pair of pivot arms (13) carrying a holder element (14) at its free end, in front of the holder element a press-down element (17) for the lifted strip part (6.4) which can be pivoted from the end position of the first pair of pivot arms (8) in the strip movement direction up to the outside circumference of a full roll (3), and a cutting device (19, 20) attached to the frame in the area between the transport element (7) in the end position (12) of the first pair of pivot arms (8) and the holder element (14) when the second pair of pivot arms (13) are pivoted up.

2. A device according to claim 1, wherein the cutting device (19, 20) contains a traverse blade (19) as the cutting element.

3. A device according to claim 1, wherein the press-down element (17) is arranged at a distance from the holder element (14), the apparatus including a blowing device (18) which blows down, attached to the pivot arms (13) in the area between the holder element (14) and the press-down element (17).

4. A device according to claim 1, wherein the press-down element (17) is a free-running roller.

5. A device according to claim 1, wherein the holder element (14) comprises a suction beam with suction cups open towards the bottom.

* * * * *